US008323427B1

(12) United States Patent
Slattery et al.

(10) Patent No.: US 8,323,427 B1
(45) Date of Patent: Dec. 4, 2012

(54) ENGINEERED SHAPES FROM METALLIC ALLOYS

(75) Inventors: Kevin T. Slattery, St. Charles, MO (US); Krishnan K. Sankaran, Saint Louis, MO (US); James B. Castle, Saint Charles, MO (US); Christopher S. Huskamp, Saint Louis, MO (US)

(73) Assignee: The Boeing Company, Chicago, IL (US)

( * ) Notice: Subject to any disclaimer, the term of this patent is extended or adjusted under 35 U.S.C. 154(b) by 352 days.

(21) Appl. No.: 12/559,206

(22) Filed: Sep. 14, 2009

(51) Int. Cl.
*C22F 1/04* (2006.01)

(52) U.S. Cl. ..... 148/523; 148/522; 148/549; 148/552; 148/559; 148/688

(58) Field of Classification Search ..... 148/522, 148/523, 549, 552, 559, 688, 691–702
See application file for complete search history.

(56) References Cited

U.S. PATENT DOCUMENTS

| | | | | |
|---|---|---|---|---|
| 6,044,685 | A * | 4/2000 | Delgado et al. | 72/356 |
| 6,134,783 | A | 10/2000 | Bargman et al. | |
| 6,779,708 | B2 | 8/2004 | Slattery | |
| 6,910,616 | B2 | 6/2005 | Halley et al. | |
| 7,083,076 | B2 | 8/2006 | Slattery et al. | |
| 7,121,309 | B2 | 10/2006 | Goemans et al. | |
| 7,128,948 | B2 | 10/2006 | Slattery | |
| 7,156,276 | B2 | 1/2007 | Slattery | |
| 7,225,967 | B2 | 6/2007 | Slattery et al. | |
| 7,347,351 | B2 | 3/2008 | Slattery | |
| 7,353,978 | B2 | 4/2008 | Slattery et al. | |
| 7,381,446 | B2 | 6/2008 | Slattery | |
| 7,398,911 | B2 | 7/2008 | Slattery et al. | |
| 7,431,194 | B2 | 10/2008 | Slattery | |
| 7,509,725 | B2 | 3/2009 | Huskamp et al. | |
| 7,515,986 | B2 | 4/2009 | Huskamp | |
| 7,607,225 | B2 | 10/2009 | Huskamp et al. | |
| 7,669,750 | B2 | 3/2010 | Slattery et al. | |

(Continued)

FOREIGN PATENT DOCUMENTS

EP 2002920 A2 12/2008

(Continued)

OTHER PUBLICATIONS

"Heat Treating Aluminum Alloys." Heat Treater's Guide: Practices and Procedures for Nonferrous Alloys. ASM International, 1996.*

(Continued)

*Primary Examiner* — Stanley Silverman
*Assistant Examiner* — Brian Walck
(74) *Attorney, Agent, or Firm* — Yee & Associates, P.C.

(57) ABSTRACT

Disclosed embodiments disclose processes for making shaped metal alloy parts, and deal more particularly with forming features and reducing residual stresses in such parts. Residual stresses introduced into a metal alloy part by heat treatment, which may include solution annealing and quenching, are reduced by processes that plastically deform the part while forming part features. An embodiment comprises: producing a metal alloy blank; subjecting the blank to a process that introduces residual stresses into the blank and plastically deforming the blank to reduce the residual stresses in the blank. Embodiments comprise: subjecting a part to a heat treatment that introduces residual stresses in the part; and age forming the part to shape the part and reduce the residual stresses, incrementally forging at least one feature into the part and reducing the residual stresses in the part, friction welding the part, or gauge rolling the cast part to desired dimensions.

23 Claims, 6 Drawing Sheets

U.S. PATENT DOCUMENTS

| | | | |
|---|---|---|---|
| 7,841,504 | B2 | 11/2010 | Slattery et al. |
| 7,854,363 | B2 | 12/2010 | Slattery et al. |
| 8,177,113 | B2 | 5/2012 | Slattery |
| 2003/0168494 | A1 | 9/2003 | Halley et al. |
| 2004/0004108 | A1 | 1/2004 | Halley et al. |
| 2004/0094604 | A1 | 5/2004 | Halley et al. |
| 2004/0112941 | A1 | 6/2004 | Slattery |
| 2005/0084701 | A1 | 4/2005 | Slattery |
| 2005/0127139 | A1 | 6/2005 | Slattery et al. |
| 2005/0127140 | A1 | 6/2005 | Slattery |
| 2006/0016854 | A1 | 1/2006 | Slattery |
| 2006/0037992 | A1 | 2/2006 | Slattery |
| 2006/0054252 | A1 | 3/2006 | Sankaran et al. |
| 2006/0059848 | A1 | 3/2006 | MacDonald-Schmidt et al. |
| 2006/0060635 | A1 | 3/2006 | Slattery et al. |
| 2006/0236544 | A1 | 10/2006 | Huskamp et al. |
| 2007/0014983 | A1 | 1/2007 | Slattery |
| 2007/0050979 | A1 | 3/2007 | Huskamp et al. |
| 2007/0075121 | A1 | 4/2007 | Slattery |
| 2007/0186507 | A1 | 8/2007 | Slattery et al. |
| 2008/0262659 | A1 | 10/2008 | Huskamp |
| 2008/0276566 | A1 | 11/2008 | Slattery et al. |
| 2008/0277451 | A1 | 11/2008 | Slattery et al. |
| 2011/0036141 | A1 | 2/2011 | Slattery et al. |

FOREIGN PATENT DOCUMENTS

| | | | |
|---|---|---|---|
| JP | 11051103 | A | 2/1999 |
| JP | 2002219585 | A | 8/2002 |
| JP | 2007152412 | A | 6/2007 |
| JP | 2002256453 | A | 9/2009 |
| WO | 2006016417 | A1 | 2/2006 |
| WO | 2011019447 | A1 | 2/2011 |

OTHER PUBLICATIONS

Kallivayalil, Jacob. "Age Forming." Metalworking: Sheet Forming, vol. 14B, ASM Handbook, ASM International, 2006, pp. 438-441.*

International Search Report, dated Oct. 12, 2010, regarding Application No. PCT/US2010/039220 (WO2011019447), 3 pages.

USPTO Office Action, dated Dec. 21, 2011, regarding U.S. Appl. No. 12/541,071, 10 pages.

* cited by examiner

ENGINEERED SHAPES FROM METALLIC ALLOYS

CROSS REFERENCE TO RELATED APPLICATIONS

This application is related to co-pending U.S. patent application Ser. No. 12/541,071, filed on Aug. 13, 2009, which is incorporated by reference herein in its entirety.

TECHNICAL FIELD

This disclosure generally relates to processes for making shaped metal alloy parts, and deals more particularly with a method of forming features and reducing residual stresses in such parts.

BACKGROUND

Unitary metallic parts may be fabricated by forging and/or machining a solid block of material. The process of machining blocks, plates or other forms of blanks may be both time consuming and expensive because a relatively large percentage of the blank may become waste material in the form of machining chips. These existing processes may have other issues, including difficulty in achieving maximum material properties from precipitation hardened alloys and/or higher than desired residual stresses present in the blank caused by the processes used to produce the blank, such as, for example and without limitation, precipitation hardening. Additionally, in some cases, existing processes for manufacturing metallic alloy blanks may require larger than desired quantities of relatively high cost metallic alloys.

Accordingly, there is a need for a method of fabricating engineered shapes from metallic alloys that reduces material waste, and reduces or nearly eliminates residual stresses in shaped parts.

SUMMARY

The disclosed embodiments provide a method of fabricating engineered shapes from metallic alloys that may substantially reduce material waste while improving material properties, including reducing residual stresses in fabricated metal alloy parts. The method may employ techniques such as incremental forging and/or friction welding to form features or build up blanks into net shaped or near net shaped parts. Plastic deformation of the metallic alloy blanks resulting from shaping techniques may reduce or nearly eliminate residual stresses present in the blanks caused by precipitation hardening or other processes that are used to fabricated the blanks.

According to one disclosed embodiment, a method is provided of manufacturing metallic alloy parts. The method comprises the steps of producing a metal alloy blank and subjecting the blank to a process that introduces residual stresses within the blank. The blank is plastically deformed in order to reduce the residual stresses in the blank. The plastic deformation may be carried out by forming at least one shape or feature in the blank, such as by incremental forging. The process that introduces residual stresses into the blank may include heating the blank and rapidly cooling the heated blank. Plastic deformation of the blank may be performed by age forming a shape into the blank or by incremental forging.

According to another disclosed embodiment, a method is provided of manufacturing an aluminum alloy part. The method comprises subjecting the part to a heat treatment process that introduces residual stresses into the part, and age forming the part in order to shape the part and reduce the residual stresses from the part. The method may further comprise forming a feature on the part by friction welding. The part may be formed by casting a molten aluminum alloy in the general shape of the part, and gauge rolling the cast part to desired dimensions. The method may also include incrementally forging at least one feature into the part. The metal alloy part may comprise one of AlCu, AlZnSc, AlZnCu, and AlMgSi. The heat treatment process may include solution annealing and/or recovery annealing.

According to a further embodiment, a method is provided of manufacturing an aluminum alloy part. The method comprises subjecting the part to a heat treatment process that introduces residual stresses into the part, and incrementally forging at least one feature into the part which reduces the residual stress in the part. The method may further comprise casting a molten aluminum alloy into the general shape of the part, gauge rolling the cast part to desired dimensions, and performing friction welding the part.

According to still another embodiment, a method is provided of introducing residual stresses present in a precipitation hardened alloy part, comprising plastically deforming the part. A plastic deformation may be carried out by friction stir welding and/or incrementally forging features into the part. The plastic deformation may also be carried out by age forming the part.

The disclosed embodiments satisfy the need for a method for fabricating engineered shapes from metallic alloys which reduces material waste while reducing or nearly eliminating residual stresses in the part caused by fabrication processes such as precipitation hardening.

BRIEF DESCRIPTION OF THE ILLUSTRATIONS

DETAILED DESCRIPTION

Figure 1:
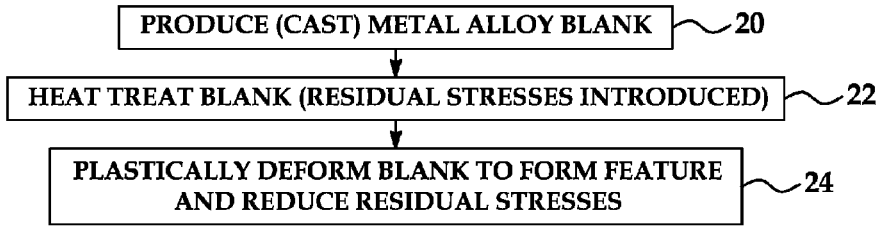
FIG. 1 is an illustration of a flow diagram showing the steps of a method of fabricating engineered shapes from metallic alloys.
Figure 2:
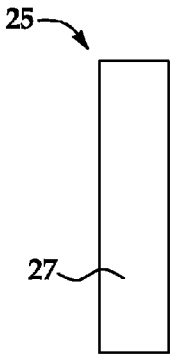
FIG. 2 is an illustration of a plan view of a cast metal alloy blank.
Figure 3:
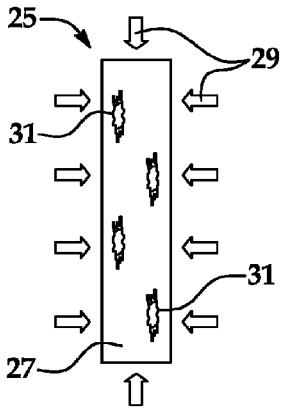
FIG. 3 is an illustration similar to FIG. 2 but depicting a process that introduces residual stresses into the blank.
Figure 4:
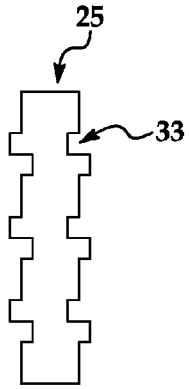
FIG. 4 is an illustration of the blank shown in FIG. 3 in which features have been formed into the blank by plastic deformation processes that reduce residual stresses in the blank.

Referring first to FIGS. 1-4, the disclosed embodiments relate to a method of manufacturing engineered shapes from metallic alloys using a substantially flat, slab-like metallic alloy blank 25 shown in FIG. 2, formed by casting or similar processes. The blank 25 may also be sometimes referred to herein as a "casting", "cast part" or "cast blank". As shown in FIG. 1, the method begins at step 20 in which the blank 25 may be produced by strip casting or slab casting a molten metal alloy into the shape of a flat slab or sheet 27 shown in FIG. 2, possibly followed by gauge rolling. Then, at step 22, the cast metal alloy blank 25 may be subjected to a heat treatment process graphically indicated by the arrows 29 in FIG. 3, in order to harden the blank 25. The heat treatment process 29 may include quenching the hot slab 27 which rapidly cools the slab 27, and may introduce residual stresses 31 into the slab 27. The residual stresses 31 comprises stresses that may remain in the cast slab 27 after the original cause of the stress has been removed. These residual stresses 31 are the result of some areas of the slab 27 contracting more than other areas as the slab 27 is quenched.

Following the heat treatment step 22, the blank 25 may be plastically deformed at step 24 in order to impart a shape to the blank 27 and/or form one or more features 33 (FIG. 4) in the blank 27. The plastic deformation performed at step 24 may also reduce or substantially eliminate the residual stresses 31 in the blank 25.

The disclosed embodiments may be advantageously employed to produce shaped blanks 25 and similar parts to near net shape using any of a variety of metal alloys including, but not limited to: AlCu, AlZnSc, AlZnCu, AlMgSi and alloys of titanium. The disclosed method may be particularly well suited to fabricating shaped blanks 25 and parts from the above mentioned alloys in which the heat treating performed at step 22 is a form of a process known as precipitation hardening. Precipitation hardening, also sometimes referred to as age hardening, is a heat treatment technique used to increase the yield strength of malleable materials including structural alloys of aluminum and other metals. The precipitation hardening process involves heating the metal alloy to a temperature of at least approximately 90 percent of absolute melting point for several hours, followed by subjecting the hot metal to a cooling medium such as water or glycol, thereby quenching the casting. Precipitation hardening relies on changes in solid solubility with temperature to produce fine particles of an impurity phase, which impede the moment of dislocations or defects in a crystal's lattice. Since dislocations are often the dominate carriers of plasticity, the resulting impurities may serve to harden the alloy material. Unlike ordinary tempering, the metal alloy must be kept at elevated temperature for several hours in order to allow precipitation to take place; this time delay is sometimes referred to as aging.

As will be discussed below, any of several techniques may be employed to plastically deform the heat treated blank 25 as part of step 24 in FIG. 1 while shaping the blank 25 and/or forming one or more features 33 in the blank 25. For example, the heat treated blank 25 may be subjected to an incremental forging process in which the features 33 are incrementally formed using a common tool set that back extrudes any of various features by heating and plasticizing successive portions of the blank and extruding these plasticized portions into local cavities formed by the toolset. Additional details of a suitable incremental forging process are described in U.S. patent application Ser. No. 12/541,071, filed on Aug. 13, 2009, the entire disclosure of which is incorporated by reference herein.

The necessary plastic deformation of the blank 25 and formation of the features 33 and/or shaping of the blank 25 may also be carried out by friction stir welding or linear friction welding in which thin strip of metal alloy (not shown) are welded together to form or build up features 33 on the blank 25. Where welding is used to shape and/or form features 33 on the blank 25, it may be advantageous to perform a subsequent heat treatment operation, such as that disclosed in US Patent Publication No. 20060054252 A1 published on Mar. 16, 2006, the entire contents of which are incorporated by reference herein. The process described in this prior patent publication solves the problem of ductility reduction by conducting a thermal exposure treatment prior to solution treatment. This thermal exposure treatment or post-weld annealing may be performed at a temperature below solution heat treatment temperature. The resultant alloy material may have restored mechanical strength with minimal decrease in original ductility. This process may result in material properties that are close to the base metal, however residual stresses in the treated blank 25 may remain.

Figure 5:
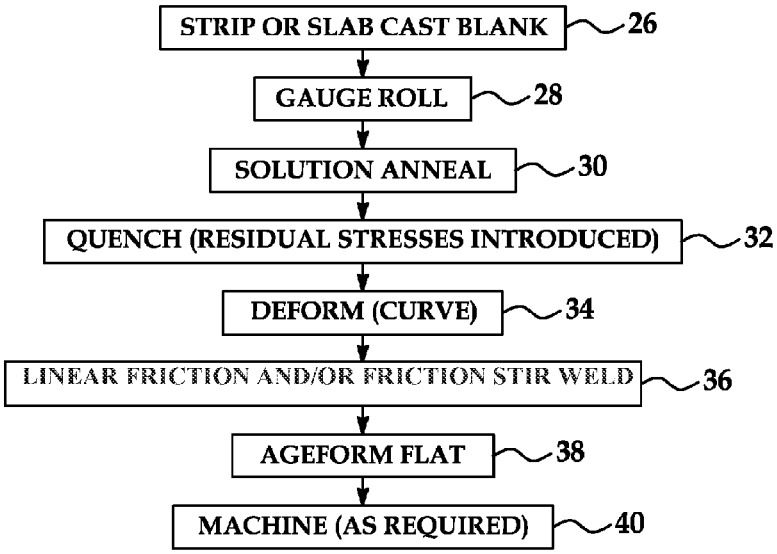
FIGS. 5-12 are illustrations of flow diagrams showing the details of alternate methods of manufacturing a metallic alloy part according to the disclosed embodiments.

Attention is now directed to FIG. 5 which illustrates the steps of one form of the method for making a blank 25 having an engineered shape and/or one or more features 33. The method begins at step 26 in which a molten metal alloy of the type discussed previously may be cast either as a strip or as a slab using conventional processes. In the case of strip casting, the molten metal may be cast on to a moving belt (not shown) to form a cast strip similar to the slab 27 shown in FIG. 2, whose thickness is a function of the viscosity of the molten metal, the velocity of the belt, surface tension, etc.

Next, at step 28, the cast blank 25 may be gauge rolled to a desired thickness or gauge, following which, at step 30, the blank 25 is solution annealed. Solution annealing is a process that involves heating the blank 25 to a temperature above approximately 950 degrees F. and maintaining this temperature for a period of time sufficient for intermetallic phases in the alloy to go into solution. Following this heating, the blank 25 may be quickly cooled to prevent the intermetallic phases from coming out of solution. After the solution annealing 30, the blank 25 may be quenched at 32 by subjecting the hot blank 25 to a cooling medium such as water or glycol. Next, at step 34, the blank 25 may be plastically deformed in order to reduce or substantially eliminate the residual stresses that may be present in the blank 27. After deforming the blank at 34, one or more features 33 may be formed by welding one or more strips (not shown) onto the deformed blank 25, as by friction stir welding or linear friction welding as described in U.S. Pat. Nos. 7,225,967 and 7,156,276, the entire disclosures of which are incorporated by reference herein.

Next, at step 38, the shaped blank 25 may be age formed by heating the blank to a temperature of approximately 250 to 350 degrees F. and applying forces to the deformed blank that urges the deformation to flatten out during the aging process. The age forming performed at step 38 may provide the necessary plastic deformation of the blank 25 that may result in reducing or eliminating residual stresses in the blank introduced by the quenching process at step 32. Finally, at step 40, the welded blank may be machined, if necessary to final dimensions in order to form a finished part. The machining performed at step 40 may be formed on only certain surfaces of the welded blank 25, or on the entire blank 25.

Figure 15:
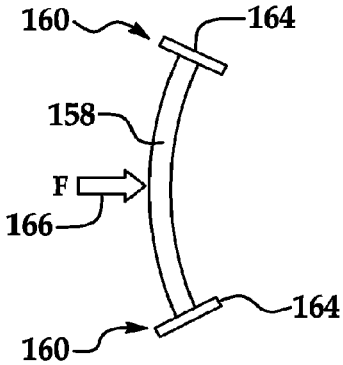
Figure 16:
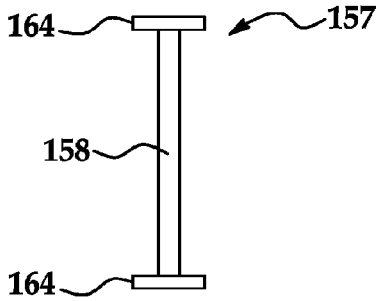

FIGS. 13-16 illustrate one technique for carrying out the steps 34, 36, 38 shown in FIG. 5. A flat blank 158 that has been solutioned annealed and quenched at steps 30, 32 in FIG. 5 is placed in a fixture 162 shown in FIG. 14 which bends and imparts a curvature to the blank 158. While the curved blank 158 is held in the fixture 162, a pair of metal caps 164 may be friction stir welded on the ends 160 of the curved blank 158. Next, as shown in FIG. 15 the curved, welded blank 158 may be subjected to age forming in which the blank 158 may be heated to a temperature of approximately 250 to 350 degrees F. while a force 166 is applied to the blank 158 which urges the blank to flatten, until the blank 158 is returned to its original flat shape as shown in FIG. 16. In this example, the finished part 157 comprises an I-beam 157.

Figure 6:
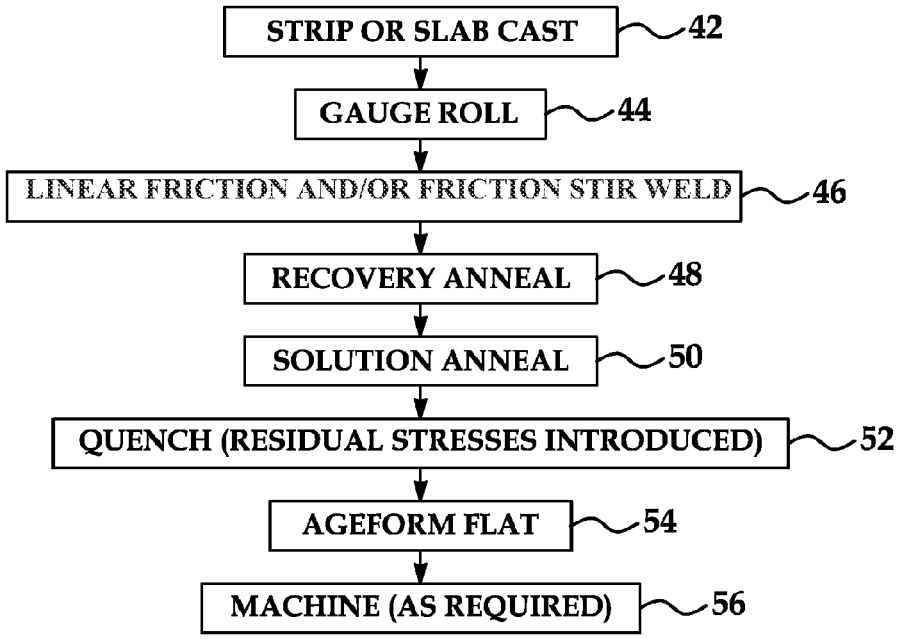

FIG. 6 illustrates an alternate form of the method for fabricating a shaped blank 25 or parts from a metal alloy. A molten metal alloy of the type previously described is strip or slab cast at 42 following which the casting 25 is gauge rolled at 44. In this example, one or more strips (not shown) may be linear friction welded or friction stir welded to the cast blank 25 at step 46, following which at step 48, the welded blank 25 may be recovery annealed. Recovery annealing is a heat treat process that partially restores the original hardness of a metal alloy while preserving its grain size. Recovery annealing may be performed at approximately 700 degrees F. and is described in more detail in US Patent Publication No. 20060054252 A1 published on Mar. 16, 2006, the entire contents of which are incorporated by reference herein. Following the recovery annealing at 48, the welded blank 25 may be subjected to solution annealing at 50. The solution annealing at 50 may be performed immediately after the recovery annealing 48 by increasing the annealing temperature from approximately 700 degrees F. to between approximately 700 and 1000 degrees F.

Following solution annealing at 50, the hot blank 25 may be quenched at 52 which may introduce residual stresses into the blank 25. At step 54, in order to reduce or substantially eliminate these residual stresses, the heat treated blank 25 may be age formed back to a flat shape. As previously discussed, age forming is a shaping process for heat treatable metal alloys in which a metal alloy is given an aging treatment while simultaneously being subjected to mechanical shaping loads such as those previously discussed in connection with FIGS. 14 and 15. Shaping of the blank 25 is achieved through creep which occurs at aging temperatures which may be between approximately 250 and 375 degrees F. Because creep is the phenomenon that is responsible for achieving the flatness age forming is sometimes referred to as creep forming. The age forming performed at step 54 may provide several advantages over conventional processes in which a metal alloy part is solution heat treated and then cold formed by shot peening or roll forming. During conventional roll forming, plastic deformation is imparted to the surface layers of the part such as after the forming loads are released, the part springs back to the desired shape. This may result in nonuniform microstructure, because the surface layer has significantly larger plastic deformation than the bulk of the part.

During the age forming performed at step 54, the forming loads may be typically lower than the yield stress of the material and the blank shape is obtained due to the low temperature creep that occurs during the aging process. Consequently, there may be less non-uniformity in the microstructure of the part and the parts may have lower residual stresses, and thus better stress corrosion resistance. The method shown in FIG. 6 ends at step 56 where optional machining may be performed on the blank 25 to bring one or more surfaces of the blank 25 to final, desired dimensions and/or surface finish.

Figure 7:
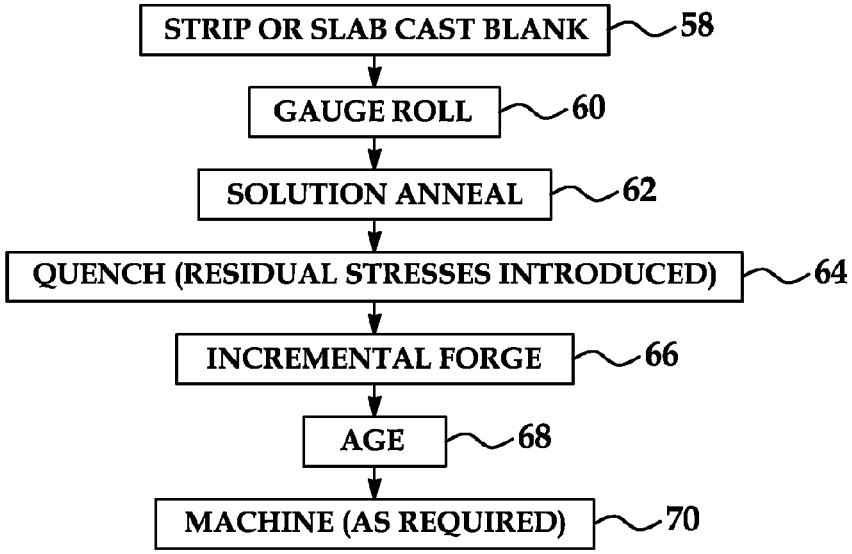

Attention is now directed to FIG. 7 which illustrates the steps of another embodiment of the method for fabricating parts from a metal alloy. The form of the method shown in FIG. 7 may include the steps of strip or slab casting the blank 25 at 58, gauge rolling the cast blank 25 at 60, solution annealing the blank 25 at 62 and then quenching the blank 25 at 64, similar to the method described in connection with FIG. 5. In this embodiment, residual stresses imparted to the metal alloy during the quenching at 64 may be reduced or substantially eliminated by plastic deformation of the metal alloy resulting from incremental forging of features 33 in the blank 25 carried out at step 66. Following the incremental forging of the blank 25 at 66, the blank 25 may be aged at step 68 in which the blank 25 is subjected to a temperature of approximately 300 degrees F. which results in precipitation hardening of the blank. Finally, at step 70, the blank 25 may be machined, as required.

Figure 8:
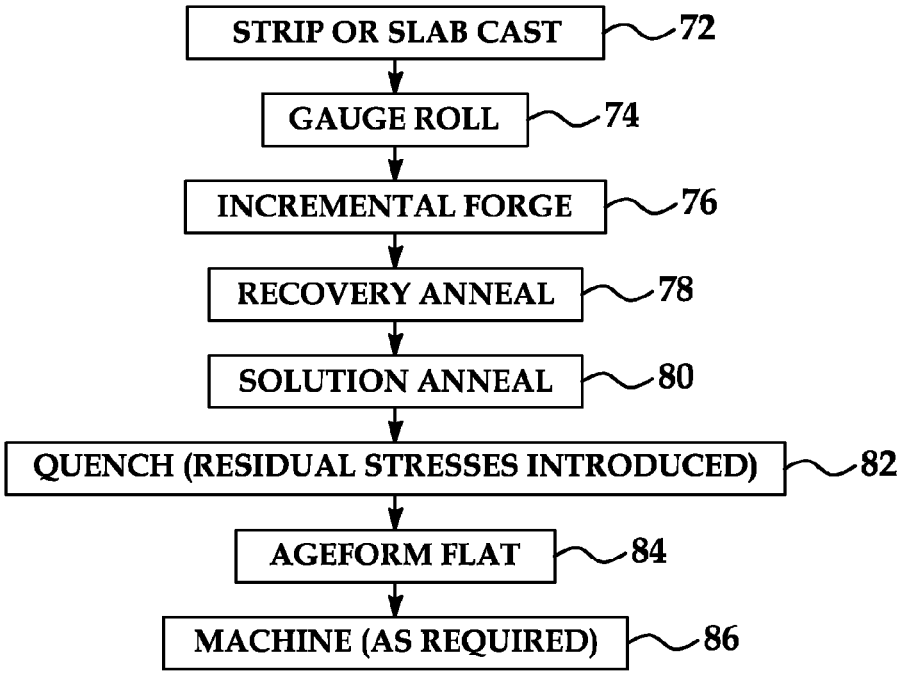

Another embodiment of the method is shown in FIG. 8. Following strip or slab casting of the blank at 72, the blank is gauge rolled at 74. One or more features 33 may be incrementally forged into the blank 25 at 76, following which the blank 25 is recovery annealed at 78 and then solution annealed at 80, similar to steps 48 and 50 shown in FIG. 6. Following solution annealing at 80, the blank 25 may be quenched at 82 which may result in the introduction of residual stresses into the blank. These residual stresses may be subsequently reduced or substantially eliminated by age forming the blank 25 back into a flat shape at 84. The blank may then be machined, as required, at step 86.

Figure 9:
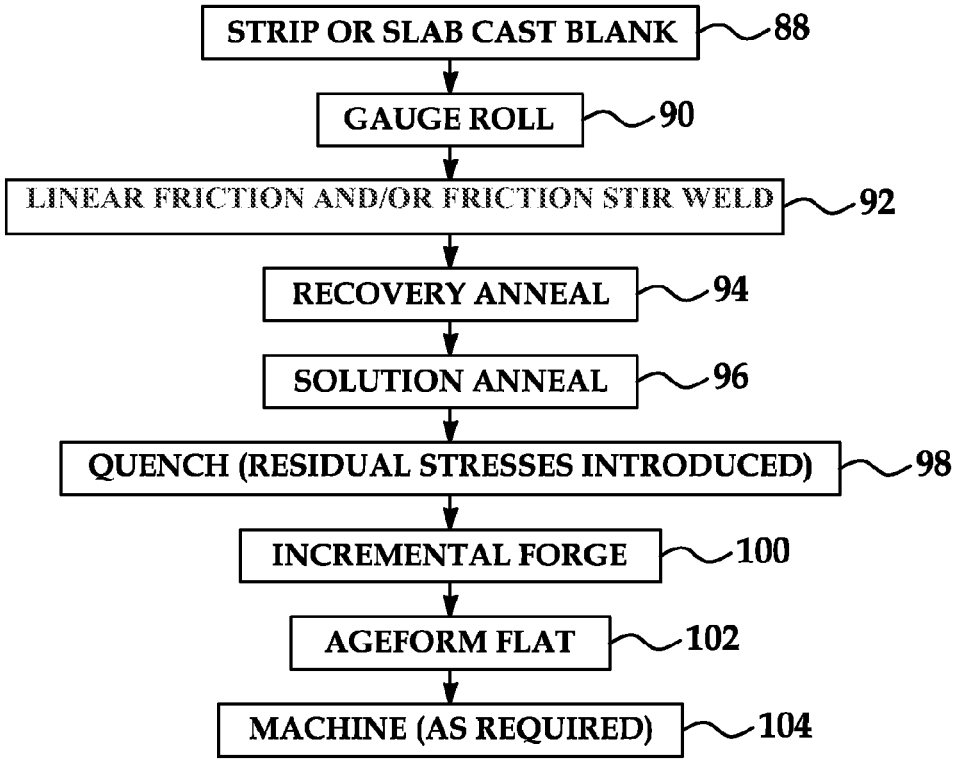

FIG. 9 illustrates another embodiment of the method in which a blank 25 is cast at 88, gauge rolled at 90 and then linear friction welded or friction stir welded at 92 to form a shape and/or features into the blank 25. The cast blank 25 may be recovery annealed at 94 and then solution annealed at 96, following which the blank 25 may be quenched at 98, which may introduce residual stresses into the blank 25. In addition to the features 33 formed by the welding process at 92, one or more additional features 33 may be incrementally forged into the blank 25 at 100. The incremental forging at 100 also may reduce residual stresses introduced into the blank 25 by the quenching process at 98. When the blank 25 has been plastically deformed, it may be age formed back to a flat shape at 102, thereby further reducing residual stresses that may be present in the blank 25. The blank 25 may be machined to final dimensions at 104.

Figure 10:
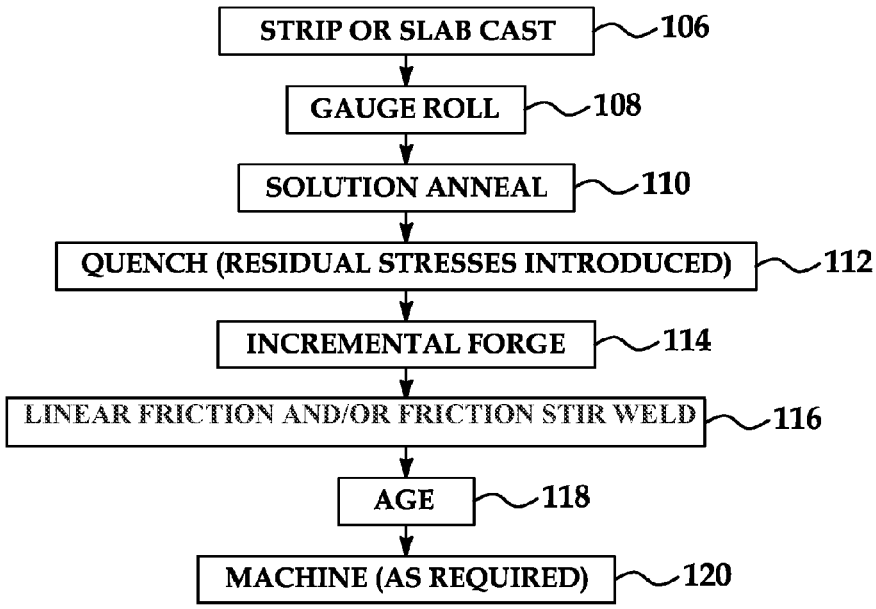

A further form of the method is illustrated in FIG. 10. A cast blank 25 is produced at 106 that is then gauge rolled at 108 and solution annealed at 110. The hot blank may be quenched at 112 following which one or more features may be incrementally forged into the casting at 114, which may reduce or substantially eliminate residual stresses introduced into the blank 25 as a result of the quenching at 112. One or more additional features 33 may then be added to the blank 33 by linear friction welding or friction stir welding at 116. At 118, the completed blank 25 may be aged at 118 and then machined, as required, at step 120.

Figure 11:
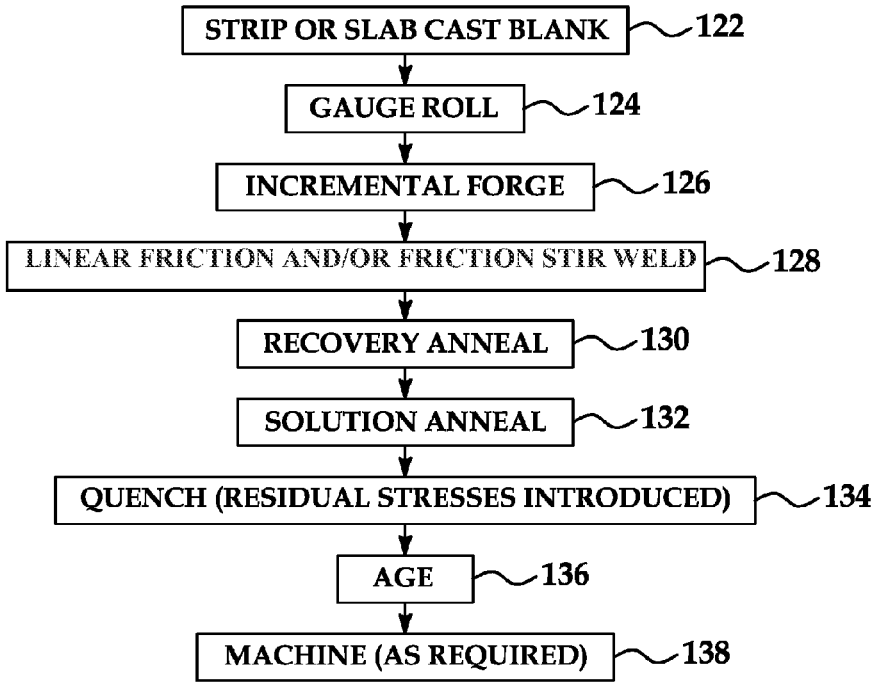
Figure 12:
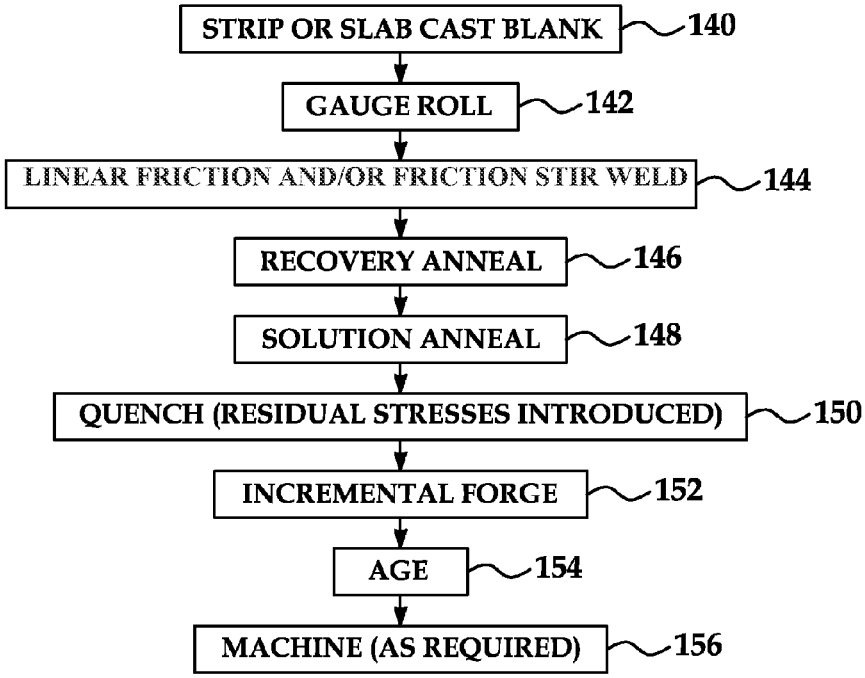
Figure 13:
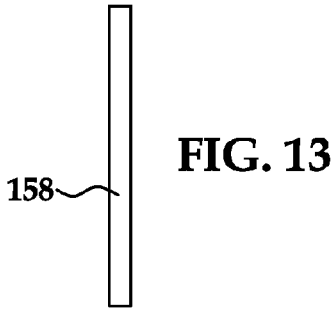
FIGS. 13-16 are illustrations showing steps used to manufacture a metallic alloy part using plastic deformation and feature forming techniques.
Figure 14:
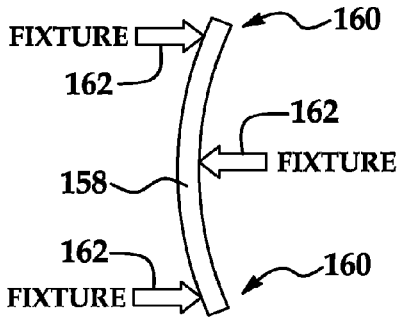

FIGS. 11 and 12 respectively illustrate steps of additional embodiments of the method in which features 33 may be formed in the blank 33 by either incremental forging or welding to build up shapes, but wherein quenching following a heat treatment occurs after the features 33 have been formed. In FIG. 11, after the blank 25 is produced at 122, it is gauge rolled at 124 and one or more features 33 are formed into the cast blank 25 by incremental forging at 126. Additional features 33 may be added to the blank 25 by linear friction welding or friction stir welding at 128. The blank 25 with completed shapes and/or features 33 may then be recovery annealed at 130 and solution annealed at 132, following which the hot blank 25 may be quickly cooled by quenching at 134. In this example, the residual stresses that may be introduced into the blank 25 by the quenching at 134 are removed by aging at 136. The blank 25 may be machined, as required, at 138.

A further embodiment of the method is illustrated in FIG. 12. In this example, the blank 25 is produced at 140 and gauge rolled at 142, following which one or more features 33 may be added to the blank by either linear friction welding or friction stir welding at 144. The blank 25 may then be recovery annealed at 146 and solution annealed at 148, following which the hot blank may be quenched at 150. The residual stresses that may be introduced into the blank 25 may be reduced or substantially eliminated as additional shapes and features 33 are formed in the blank 25 by incremental forging at 152. The blank 25 may then be aged at 154 following which it may be machined to final dimensions, if necessary, at 156.

Figure 17:
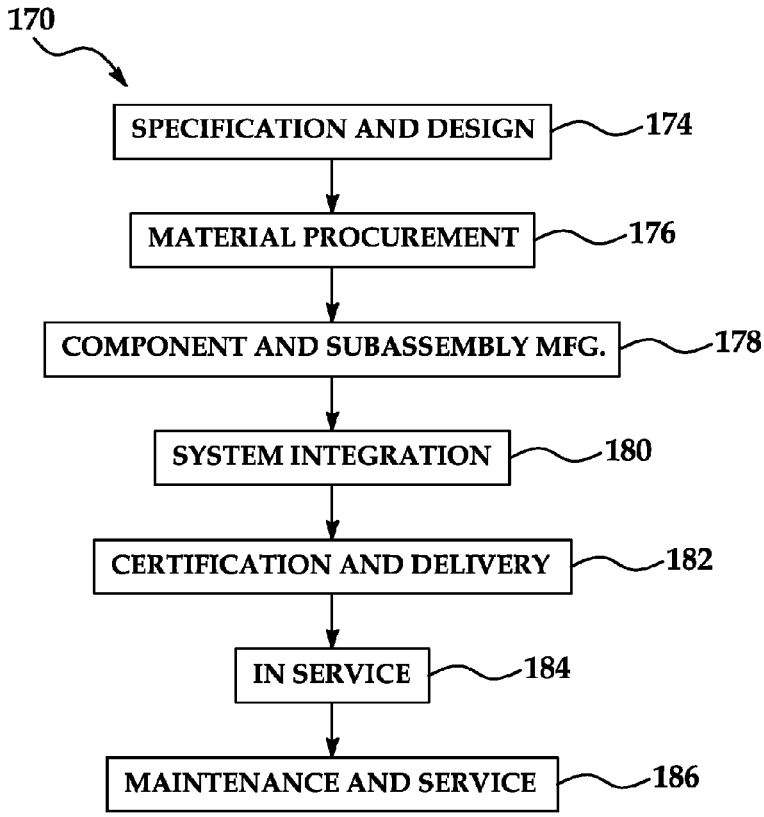
FIG. 17 is an illustration of a flow diagram of aircraft production and service methodology.
Figure 18:
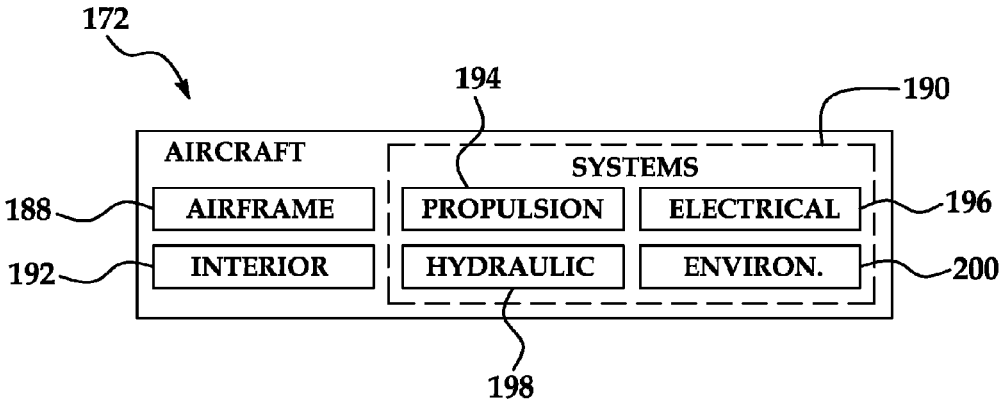
FIG. 18 is an illustration of a block diagram of an aircraft.

Embodiments of the disclosure may find use in a variety of potential applications, particularly in the transportation industry, including for example, aerospace, marine and automotive applications. Thus, referring now to FIGS. 17 and 18, embodiments of the disclosure may be used in the context of an aircraft manufacturing and service method 170 as shown in FIG. 17 and an aircraft 172 as shown in FIG. 18. During pre-production, exemplary method 170 may include specification and design 174 of the aircraft 172 and material procurement 176 in which the disclosed method may be specified for use in making metal alloy parts and components used in the aircraft 172. During production, component and subassembly manufacturing 178 and system integration 180 of the aircraft 172 takes place. The disclosed method may be used to manufacture metal alloy components during these production processes. Thereafter, the aircraft 172 may go through certification and delivery 182 in order to be placed in service 184. While in service by a customer, the aircraft 172 is scheduled for routine maintenance and service 186 (which may also include modification, reconfiguration, refurbishment, and so on). The disclosed method may be used to cure replacement composite parts which are installed during the maintenance and service 186.

Each of the processes of method 170 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 18, the aircraft 172 produced by exemplary method 170 may include an airframe 188 with a plurality of systems 190 and an interior 192. The disclosed method be used to produce metal alloy components which form part of, or may be installed on the airframe 188. Examples of high-level systems 190 include one or more of a propulsion system 194, an electrical system 196, a hydraulic system 198, and an environmental system 200. Any number of other systems may be included. Although an aerospace example is shown, the principles of the disclosure may be applied to other industries, such as the marine and automotive industries.

The disclosed method may be employed to produce metal alloy parts and components during any one or more of the stages of the production and service method 170. For example, components or subassemblies corresponding to production process 170 may incorporate metal alloy parts that are made according to the disclosed method. Also, one or more method embodiments, or a combination thereof may be utilized during the production stages 178 and 180, for example, by substantially expediting assembly of or reducing the cost of an aircraft 172. Similarly, the disclosed method may be used to produce metal alloy components and parts that are utilized while the aircraft 172 is in service 184.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A method of manufacturing a metal alloy part, comprising:

producing a metal alloy blank, followed by gauge rolling the blank, to create a gauged blank;

introducing residual stresses into the gauged blank, wherein introducing residual stresses into the gauged blank comprises solution annealing the gauged blank followed by quenching the gauged blank in a cooling medium, wherein a solutionized and quenched blank is formed, and solution annealing further comprises heating the gauged blank until intermetallic phases in the gauged blank to go into solution;

reducing the residual stresses in the solutionized and quenched blank after quenching by plastically deforming the solutionized and quenched blank, wherein a non-linear blank is formed;

friction welding a metal alloy strip onto the non-linear blank;

further reducing residual stress in the non-linear blank while enhancing corrosion resistance of the non-linear blank, wherein further reducing residual stress while enhancing corrosion resistance comprises: creep forming the non-linear blank, wherein creep forming the non-linear blank comprises: heating the non-linear blank to approximately 250 to 350 degrees Fahrenheit while applying force to flatten the non-linear blank, wherein a flattened blank is formed; and, forming the metal alloy part by machining a surface on the flattened blank.

2. The method of claim 1, wherein plastically deforming the solutionized and quenched blank includes deforming the solutionized and quenched blank by placing the solutionized and quenched blank in a fixture that imparts a non-linear shape to the solutionized and quenched blank.

3. The method of claim 1, wherein the metal alloy blank is one of:

AlCu,

AlZnSc,

AlZnCu, a titanium alloy, and

AlMgSi.

4. The method of claim 1, wherein:

producing the blank includes casting a molten alloy metal into at least one of a strip or a slab, wherein gauge rolling the strip or the slab includes selecting a desired thickness or gauge for the strip or the slab; and, introducing residual stresses into the gauged blank includes heating the gauged blank to a temperature of at least about 90 percent of an absolute melting point of the metal alloy comprising the gauged blank.

5. The method of claim 1, wherein:

introducing residual stresses into the gauged blank includes rapidly cooling the heated gauged blank, in a-cooling medium comprised of at least one of: water, and glycol.

6. The method of claim 1, wherein:

plastically deforming the solutionized and quenched blank includes age forming a curved shape into the blank.

7. The method of claim 1, wherein, performing friction welding on the non-linear blank comprises at least one of: friction stir welding, and linear friction welding.

8. A method of manufacturing a metal alloy part, comprising:

producing a metal alloy blank, wherein producing the metal alloy blank comprises casting at least one of a strip or a slab from a molten metal alloy, followed by gauge rolling the strip or the slab, wherein a gauged blank is created, and wherein gauge rolling the strip or the slab includes selecting a thickness or gauge for the strip or the slab;

adding a feature to the gauged blank, wherein a forged blank is formed, wherein adding a feature comprises at least one of: friction welding a metal alloy strip onto the gauged blank and altering an original grain size of the gauged blank by plastically deforming the gauged blank via incremental forging, wherein incremental forging comprises successively heating and plasticizing a portion of the gauged blank and forming the feature on each successively plasticized portion of the gauged blank by using a programmable back extrusion tool set with customizable cavities;

partially restoring an original hardness of the forged blank while preserving a grain size in the forged blank by recovery annealing the forged blank, wherein a recovered blank is formed;

subjecting the part to a heat treatment process that introduces residual stresses into the recovered blank, wherein introducing residual stresses comprises solution annealing the recovered blank followed by quenching the recovered blank in a cooling medium, wherein a quenched blank is formed;

age forming the quenched blank to shape the quenched blank and reduce the residual stresses in the quenched blank while enhancing corrosion resistance of the quenched blank, wherein an age formed blank is formed, and wherein age forming the quenched blank further comprises: heating the quenched blank to approximately 250 to 350 degrees Fahrenheit while applying force to flatten the quenched blank; and, forming the metal alloy part by machining a surface on the age formed blank to form the metal alloy part.

9. The method of claim 8, wherein subjecting the part to heat treatment further comprises, wherein the solution annealing comprises heating the recovered blank above approximately 90 percent of an absolute melting point of the metal alloy comprising the recovered blank until intermetallic phases in the recovered blank go into solution, and further wherein the cooling medium comprises at least one of: water, and glycol.

10. The method of claim 8, wherein casting at least one of a strip or a slab from molten metal alloy further comprises:

casting a molten aluminum alloy into a general shape of the metal alloy part.

11. The method of claim 8, wherein adding a feature the to the gauged blank by friction welding comprises at least one of: linear friction welding the metal alloy strip onto the gauged blank, and friction stir welding the metal alloy strip onto the gauged blank.

12. The method of claim 8, wherein the metal alloy part is one of:

AlCu,
AlZnSc,
AlZnCu,
and
AlMgSi.

13. The method of claim 8, wherein recovery annealing comprises heating the forged blank to approximately 700 degrees Fahrenheit.

14. A method of manufacturing a metal alloy part, comprising:

producing a metal alloy blank, wherein producing the metal alloy blank comprises casting at least one of a strip or a slab from molten metal alloy, followed by gauge rolling the strip or the slab, wherein a gauged blank is created, wherein gauge rolling the strip or the slab includes selecting a thickness or gauge for the strip or the slab;

adding a feature to the gauged blank, wherein a featured blank is created;

subjecting the featured blank to a heat treatment process that introduces residual stresses in the featured blank, wherein a friction welded double annealed blank is formed;

incrementally forging at least one feature into the friction welded double annealed blank, and reducing the residual stresses in the friction welded double annealed blank and altering an original grain size of the friction welded double annealed blank by plastically deforming the friction welded double annealed blank via incremental forging, wherein an incrementally forged blank is created, wherein incremental forging comprises: successively heating and plasticizing a portion of the friction welded double annealed blank and forming the feature on each successively plasticized portion of the friction welded double annealed blank by using a programmable back extrusion tool set with customizable cavities;

hardening the incrementally forged blank by aging the blank, wherein an aged blank is formed, wherein aging the blank comprises heating the incrementally forged blank to approximately 250 to 350 degrees Fahrenheit; and, forming the metal alloy part by machining on a surface the aged blank to form the metal alloy part.

15. The method of claim 14, further comprising:

wherein adding a feature comprises at least one of: linear friction welding a first metal alloy strip onto the gauged blank, and friction stir welding a second metal alloy strip onto the gauged blank.

16. The method of claim 14, wherein the metal alloy part is one of:

AlCu,
AlZnSc,
AlZnCu,
and
AlMgSi.

17. The method of claim 14, wherein subjecting the part to a heat treatment process includes at least one of:

preserving a hardness of the featured blank while partially restoring the original grain size in the featured blank by recovery annealing the featured blank, wherein a recovered blank is created, wherein recovery annealing comprises heating the incrementally forged blank to approximately 700 degrees Fahrenheit; and, introducing residual stresses into the recovered blank by solution annealing the recovered blank followed by quenching the recovered blank in a cooling medium, wherein a friction welded double annealed blank is created, wherein the solution annealing comprises heating the recovered blank above approximately 90 percent of an absolute melting point of the metal alloy comprising the recovered blank until intermetallic phases in the recovered blank to go into solution, and further wherein the cooling medium comprises at least one of: water, and glycol.

18. A method of reducing residual stresses present in a precipitation hardened metal alloy part, comprising:

producing a metal alloy blank, wherein producing the metal alloy blank comprises casting at least one of a strip or a slab from molten metal alloy, followed by gauge rolling the strip or the slab, wherein a gauged blank is created, wherein gauge rolling the strip or the slab includes selecting a thickness or gauge for the strip or the slab;

introducing residual stress into the gauged blank, wherein introducing residual stress comprises solution annealing the gauged blank followed by quenching the gauged blank in a cooling medium, wherein an annealed blank is created, wherein the solution annealing comprises heating the gauged blank above approximately 90 percent of an absolute melting temperature of the metal alloy in the gauged blank until intermetallic phases in the gauged blank to go into solution, and further wherein the cooling medium comprises at least one of: water, and glycol;

reducing the residual stresses of the annealed blank in successive portions, after quenching the annealed blank in a cooling medium, by plastically deforming the annealed blank via incremental forging, wherein an incrementally forged blank is created;

increasing a yield strength of the incrementally forged blank, wherein increasing the yield strength of the incrementally forged blank comprises precipitation hardening the incrementally forged blank, wherein a hardened blank is created; and, forming the precipitation hardened metal alloy part by machining on a surface of the hardened blank to form the precipitation hardened metal alloy part.

19. The method of claim 18, further comprising: adding a feature to the incrementally forged blank before age hardening the incrementally forged blank, wherein adding additional features comprises performing one of: friction stir welding, and linear friction welding, on the incrementally forged blank.

20. The method of claim 18, wherein incrementally forging comprises successively heating and plasticizing a portion of the annealed blank and incrementally forming a feature on each successively plasticized portion of the annealed blank by using a programmable back extrusion tool set with customizable cavities.

21. The method of claim 18, wherein precipitation hardening comprises age hardening the incrementally forged blank, wherein a hardened blank is created, wherein age hardening the incrementally forged blank comprises subjecting the incrementally forged blank to a temperature of approximately 250 to 350 degrees Fahrenheit.

22. A method of manufacturing a precipitation hardened metal alloy part, comprising:

casting a metal alloy into a general shape of the part, wherein a cast part is created;

gauge rolling the cast part to a desired thickness, wherein a gauged blank is created;

plastically deforming the gauged blank, wherein plastically deforming the gauged blank comprises altering an original grain size of the gauged blank via incremental forging, wherein an incrementally forged blank is created, wherein incremental forging comprises successively heating and plasticizing a portion of the gauged blank and forming features on each successively plasticized portion of the gauged blank by using a programmable back extrusion tool set with customizable cavities;

adding a feature to the incrementally forged blank, wherein a formed blank is created, wherein adding a feature comprises at least one of: linear friction welding a first metal alloy strip onto the incrementally forged blank, and friction stir welding a second metal alloy strip onto the incrementally forged blank, subjecting the formed blank to recovery annealing, wherein recovery annealing comprises preserving the original grain size of the formed blank while partially restoring a hardness in the formed blank by recovery annealing the formed blank, wherein a recovered blank is created, wherein recovery annealing comprises heating the formed blank to approximately 700 degrees Fahrenheit;

subjecting the recovered blank to solution annealing followed by quenching the recovered blank in a cooling medium, wherein an incrementally forged double annealed blank is created, wherein the solution annealing comprises heating the recovered blank above approximately 90 percent of the absolute melting temperature of the metal alloy in the recovered blank until intermetallic phases in the recovered blank go into solution, and further wherein the cooling medium comprises at least one of: water, and glycol;

increasing a yield strength of the incrementally forged double annealed blank by precipitation hardening the incrementally forged double annealed blank, wherein the precipitation hardening comprises age hardening the incrementally forged double annealed blank, wherein a hardened blank is created, wherein age hardening the incrementally forged double annealed blank comprises subjecting the incrementally forged double annealed blank to a temperature of approximately 250 to 350 degrees Fahrenheit; and, forming the precipitation hardened metal alloy part by machining on a surface of the hardened blank to form the precipitation hardened metal alloy part.

23. The method of claim 14, wherein further reducing residual stress in the incrementally forged blank by aging the blank further comprises enhancing corrosion resistance of the incrementally forged blank by creep forming the incrementally forged blank, wherein creep forming the incrementally forged blank comprises: heating the non-linear blank to approximately 250 to 350 degrees Fahrenheit while applying force to flatten the incrementally forged blank.

* * * * *